US007044400B2

(12) United States Patent
Luedicke

(10) Patent No.: US 7,044,400 B2
(45) Date of Patent: May 16, 2006

(54) SOLENOID END CAP ASSEMBLY WITH FLAT SURFACE

(75) Inventor: Martin Luedicke, Columbia, SC (US)

(73) Assignee: Siemens Diesel Systems Technology, Blythewood, SC (US)

( * ) Notice: Subject to any disclaimer, the term of this patent is extended or adjusted under 35 U.S.C. 154(b) by 69 days.

(21) Appl. No.: 10/232,599

(22) Filed: Sep. 3, 2002

(65) Prior Publication Data

US 2004/0046043 A1 Mar. 11, 2004

(51) Int. Cl.
*F02M 47/02* (2006.01)

(52) U.S. Cl. ..... 239/88; 239/93; 239/95; 239/96; 239/533.2; 239/585.1; 239/90; 335/256; 137/625.65

(58) Field of Classification Search ..... 239/88–96, 239/533.2–533.11, 585.1–585.5; 251/129.1; 137/625.65; 335/256, 257, 266, 306, 255
See application file for complete search history.

(56) References Cited

U.S. PATENT DOCUMENTS 2,879,788 A * 3/1959 Beckett et al. ..... 137/454.6
2,916,019 A * 12/1959 Murphy ..... 137/625.65
2,983,285 A * 5/1961 Gardner ..... 137/625.65
3,004,720 A 10/1961 Knapp et al.
3,441,056 A * 4/1969 Cleland ..... 137/625.65
3,527,253 A * 9/1970 Harpman ..... 137/625.27
4,662,605 A 5/1987 Garcia
4,719,943 A * 1/1988 Perach ..... 137/625.65
4,821,773 A * 4/1989 Herion et al. ..... 137/625.65
4,852,612 A * 8/1989 Bucko, Sr. ..... 137/625.5
4,886,091 A * 12/1989 Coleman ..... 137/625.65
4,949,741 A * 8/1990 Nowicki et al. ..... 137/1
5,100,102 A 3/1992 Schechter
5,460,329 A * 10/1995 Sturman ..... 239/96
5,890,662 A 4/1999 Dykstra
5,937,904 A * 8/1999 Wunder ..... 137/625.65
6,006,783 A * 12/1999 Luhmann et al. ..... 137/625.65
6,209,563 B1 * 4/2001 Seid et al. ..... 137/15.21
6,631,853 B1 * 10/2003 Lenk et al. ..... 239/90

* cited by examiner

*Primary Examiner*—Dinh Q. Nguyen
(74) *Attorney, Agent, or Firm*—McGuireWoods LLP

(57) ABSTRACT

A solenoid end cap assembly having a flat mating surface. The flat mating surface is a single planar mating surface and is designed to mate with a substantially flat mating surface of a valve control body. The solenoid, housed within the solenoid end cap, does not protrude past the flat surface and may form part of the substantially flat mating surface of the solenoid end cap. The flat mating surfaces of the valve control body and the solenoid end cap assembly eliminates the need for ring dowels in the assembly between the solenoid and the valve control body. This reduces manufacturing costs and assembly time. The flat mating surfaces also provide a uniform mounting surface for the solenoid from injector to injector. This increases performance characteristics, as well as increases thermal conductivity and magnetic conductivity characteristics.

32 Claims, 4 Drawing Sheets

SOLENOID END CAP ASSEMBLY WITH FLAT SURFACE

BACKGROUND OF THE INVENTION

1. Field of the Invention

The present invention generally relates to an end cap assembly for housing a solenoid adapted for use with a fuel injector and, more particularly, to a solenoid end cap assembly with a flat surface.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a valve control body may be provided with two, three or four way valve systems, each having grooves or orifices which allow fluid communication between working ports, high pressure ports and venting ports of the valve control body of the fuel injector and the inlet area. The working fluid is typically engine oil or other types of suitable hydraulic fluid which is capable of providing a pressure within the fuel injector in order to begin the process of injecting fuel into the combustion chamber.

In current fuel injector designs as shown in FIG. 1, a dowel ring assembly 101 is used to couple open and closed coil solenoids 100A and 100B to respective sides of a valve control body 102 of the fuel injector. The open and closed coil solenoids 100A and 100B include respective protruding coils 100$A_1$ and 100$B_1$. Both the ring dowel assembly 101 and the respective protruding coils 100$A_1$ and 100$B_1$ are set within a cut or milled portion 102A of the valve control body 102 (typically referred to as a "seat"). The cut portion 102A also provides a pathway (i.e., a magnetic circuit) for magnetic flux flowing between the open and closed coil solenoids 100A and 100B, the valve control body 102 and a spool 110 and back to the open and closed coil solenoids 100A and 100B.

In operation, a driver will first deliver a current or voltage to an open side of the open coil solenoid 100A. This current or voltage generates high temperatures about the open and closed solenoids which need to be dissipated by a heat sink. In any event, the magnetic force generated in the open coil solenoid will shift the spool 110 into the open position so as to align grooves or orifices 108 (hereinafter referred to as "grooves") of the valve control body and the spool 110. The alignment of the grooves 108 permits working fluid to flow into an intensifier chamber from an inlet portion 104 of the valve control body via working ports 106. The high pressure working fluid then acts on an intensifier piston to compress fuel located within a high pressure plunger chamber. As the pressure in the high pressure plunger chamber increases, the fuel pressure will begin to rise above a needle check valve opening pressure. At the prescribed fuel pressure level, a needle check valve will shift against a needle spring and open injection holes in a nozzle tip. The fuel will then be injected into the combustion chamber of the engine.

To end the injection cycle, the driver will deliver a current or voltage to a closed side of the closed coil solenoid 100B (again generating high temperatures). The magnetic force generated in the closed coil solenoid will then shift the spool 110 into the closed or start position which, in turn, will close the working ports 106 of the valve control body. The working fluid pressure will then drop in the intensifier chamber and high-pressure chamber such that the needle spring will shift the needle to the closed position. The nozzle tip, at this time, will close the injection holes and end the fuel injection process. At this stage, the working fluid is then vented from the fuel injector via vent holes surrounding the valve control body.

This type of conventional assembly and especially the use of the dowel ring assembly presents many problems during the operation of the fuel injector, itself, as well as in the manufacturing process. First, in order to use the dowel ring assembly, a ring dowel seat must be milled into both the solenoid cap and the valve control body of the fuel injector. This is a complicated process which requires very tight manufacturing tolerances. However, it is very difficult, if not impossible, to provide the same exact diametrical clearances for each ring dowel seat from one fuel injector to the another fuel injector. It is only practical to provide tolerances within a certain range for each fuel injector, thereby resulting in certain built-in variances for each ring dowel seat. This, of course, results in the ring dowel assembly and hence the coil solenoids being seated on the valve control body differently for each injector (due to the different diametrical clearances). Due to these variances, the transmission of magnetic flux or conductivity will vary from fuel injector to fuel injector thereby producing different performance characteristics of the fuel injector; that is, the spool will shift at different rates. This is an undesirable effect which may contribute to an inefficiency of the engine operations.

The different diametrical clearances and the use of the ring dowel assembly in conventional systems also affect the thermal conductivity or transmission of heat between the parts of the fuel injector. For example, in use, the parts of the fuel injector are typically heated to temperatures within the outer limits of their tolerances. In using a ring dowel assembly, the seating of the solenoid coils and the solenoid cap, itself, may result in a space or gap between the valve control body and the solenoid coils. In this scenario, heat cannot be efficiently transmitted from the solenoid coils to the control valve body. In some types of engines, this may cause overheating of the solenoid coils, potentially damaging the solenoid coils or other parts of the fuel injector. If this happens, the solenoid coils must be replaced which adds to overall maintenance costs.

Lastly, in conventional systems, the overall cost of manufacturing the fuel injector remains high. By using the ring dowel assembly, separate precise and exacting milling processes have to be provided to the solenoid cap and the control valve body. Additionally, added pieces are required and, importantly, added assembly steps are required in order to assemble the fuel injector. These added steps include, amongst others, press fitting the ring dowel into the solenoid cap.

The present invention is directed to overcoming one or more of the problems as set forth above.

SUMMARY OF THE INVENTION

In a first aspect of the present invention, a solenoid end cap assembly which may be coupled to a control valve body of a fuel injector is provided. The solenoid end cap assembly has a body having a substantially hollow interior portion and a substantially flat mating surface. A solenoid coil is housed within the interior portion. In embodiments, a receptacle having connector terminals extend outward from the body and routes solenoid wires away from the control valve body thus eliminating fraying or fatigue of the solenoid wires. In further embodiments, at least one protruding alignment pin extends from the solenoid end cap assembly and mates with the control valve body. In further embodiments, the mating face of the solenoid coil forms part of the substantially flat surface (i.e., does not extend past the substantially flat surface). The substantially flat mating surface is preferably a single planar surface and the solenoid coil forms part of the single planar surface.

In another aspect of the present invention, a solenoid end cap assembly includes a body having a substantially hollow interior portion and a substantially flat mating surface. A solenoid coil is housed within the substantially hollow interior portion. A receptacle extends away from the body and houses connector terminals that connect to solenoid wires. At least one protruding alignment pin extends outward from the substantially flat mating surface of the body.

In still another aspect of the present invention, a control valve body assembly for use with a fuel injector is provided. In this aspect, the control valve includes a body having at least one substantially flat surface at opposing sides thereof and at least one indentation formed on the opposing sides of the body. The control valve further includes an oil inlet and outlet and a fluid pathway providing fluid communication between the oil inlet area and the oil outlet. At least one solenoid end cap having a substantially flat surface mates with the at least one substantially flat surface of the body of the control valve. The at least one indentation and the at least one solenoid end cap form a space that regulates the magnetic flux pathway. A protruding alignment pin and a receptacle may extend from the flat surface of the solenoid end cap. In further embodiments:

1. the at least one solenoid end cap is a first solenoid end cap and a second solenoid end cap;
2. the outward extending receptacle of the first solenoid end cap includes four connector terminals extending therefrom; and
3. the outward extending receptacle of the second solenoid end cap includes two connector terminals extending therefrom.

In yet another aspect of the present invention, a fuel injector is provided. The fuel injector includes a control valve body assembly, an intensifier body and a nozzle assembly, all in fluid communication with one another. The control valve body assembly includes, amongst other features, a body having at least one substantially flat surface at opposing sides thereof and at least one solenoid end cap having a substantially flat surface that mates with the flat mating surface of the body of the control valve.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to an end cap assembly for housing a solenoid for use with a fuel injector and, more particularly, to a solenoid end cap assembly with a flat mating surface. In the configuration of the present invention, manufacturing costs are reduced due to the elimination of a ring dowel seat for mounting a ring dowel assembly. That is, the use of a flat surface eliminates the need for additional milling and assembly processes. Additionally, both thermal and magnetic conductivity are increased thereby increasing the efficiency of the fuel injector, itself.

Figure 2:
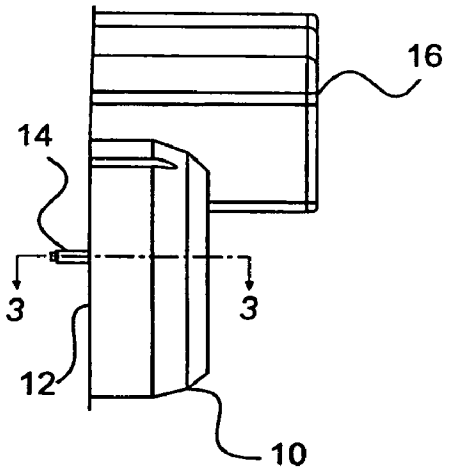
FIG. 2 shows a side view of a solenoid end cap assembly of the present invention.

Embodiments of the Solenoid End Cap Assembly and Related Components of the Present Invention Referring now to FIG. 2, a side view of a solenoid end cap design of the present invention is shown. The solenoid end cap is generally depicted as reference numeral 10 and includes a substantially flat mating surface 12 which contacts a surface of the control valve body (shown in FIG. 6). Being more specific, the flat mating surface 12 is comprised of a single planar surface. At least one alignment pin 14 extends outward from the substantially flat surface 12. A receptacle or housing 16 is coupled, and preferably over molded, to the solenoid end cap 10.

Figure 1:
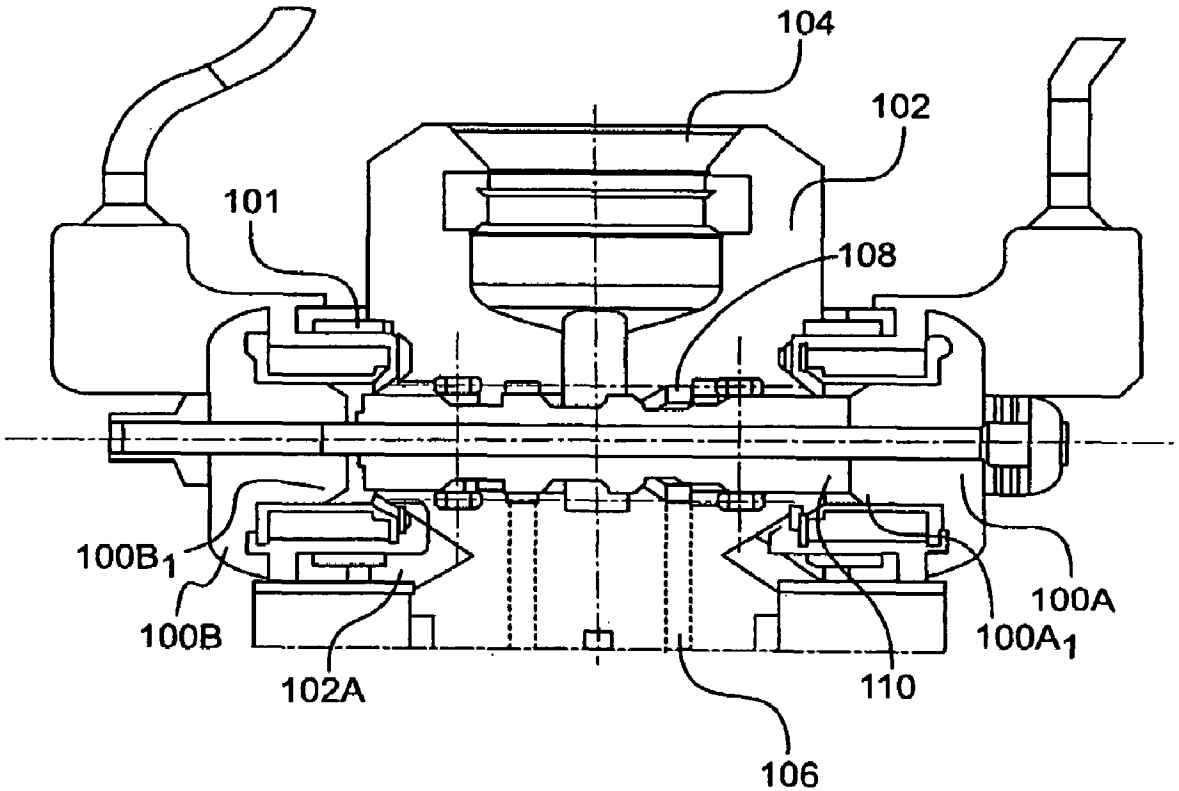
FIG. 1 shows a conventional control valve body of an oil activated fuel injector.
Figure 3:
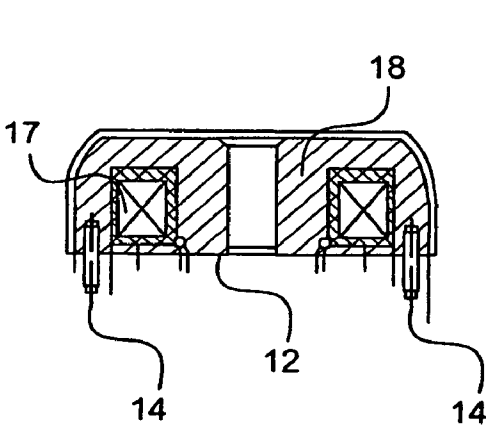
FIG. 3 shows a cut away view of an embodiment of the solenoid end cap assembly of the present invention.

FIG. 3 shows a cut away side view of the solenoid end cap of FIG. 2 along line 3—3. In this view, two alignment pins 14 are shown. A wire winding 17 is provided about a coil 18 of the solenoid end cap 10. As seen, both the wiring winding 17 and the coil 18 are housed within the solenoid end cap 10, and preferably constitute the solenoid, itself. The coil 18 does not extend past the flat surface 12 of the solenoid end cap 10 and, in embodiments, forms part of the flat surface 12. The alignment pins 14 are, in embodiments, molded into the edge of the solenoid end cap 10; however, it should be understood by those of ordinary skill in the art that the alignment pins 14 may be equally placed or mounted at other convenient locations.

Figure 5:
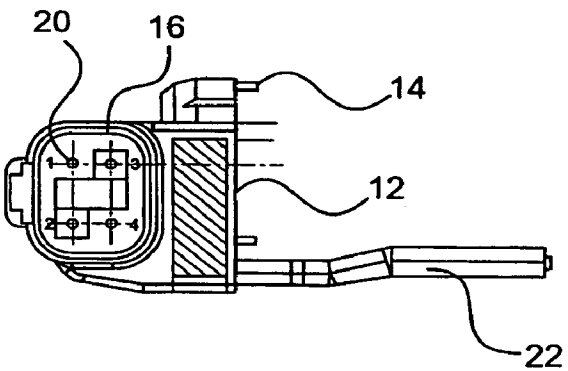
FIG. 5 shows a top view of another embodiment of the solenoid end cap assembly of the present invention.
Figure 4:
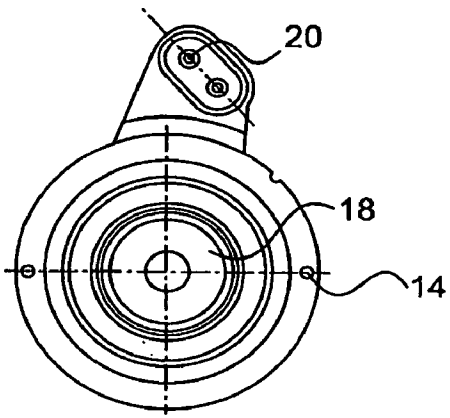
FIG. 4 shows a front view of the solenoid end cap assembly of FIG. 2.

FIG. 4 shows a front view of the solenoid end cap assembly of FIG. 2. In this view, it is shown that the housing 16 includes two connector terminals 20. In embodiments, as shown in FIG. 5, for example, the housing may include four connecting terminals 20. The connecting terminals 20 of either FIG. 4 or FIG. 5 allow solenoid wires to be connected between (i) open and closed solenoids and (ii) the connecting terminals of a solenoid coil end cap and an engine wire harness assembly. In the preferred designs, the housing 16 extends away from the control valve body and assists in routing the solenoid wires away from the control valve body. This will ensure that the rocker arm assemblies as well as the fluid being ejected from the fuel injector will not fray, fatigue or otherwise cause a failure of the solenoid wires. Additionally, this configuration also ensures that the solenoid wires remain substantially stationary thereby preventing any fatigue or failure of the solenoid wires caused by vibrational events.

Figure 7:
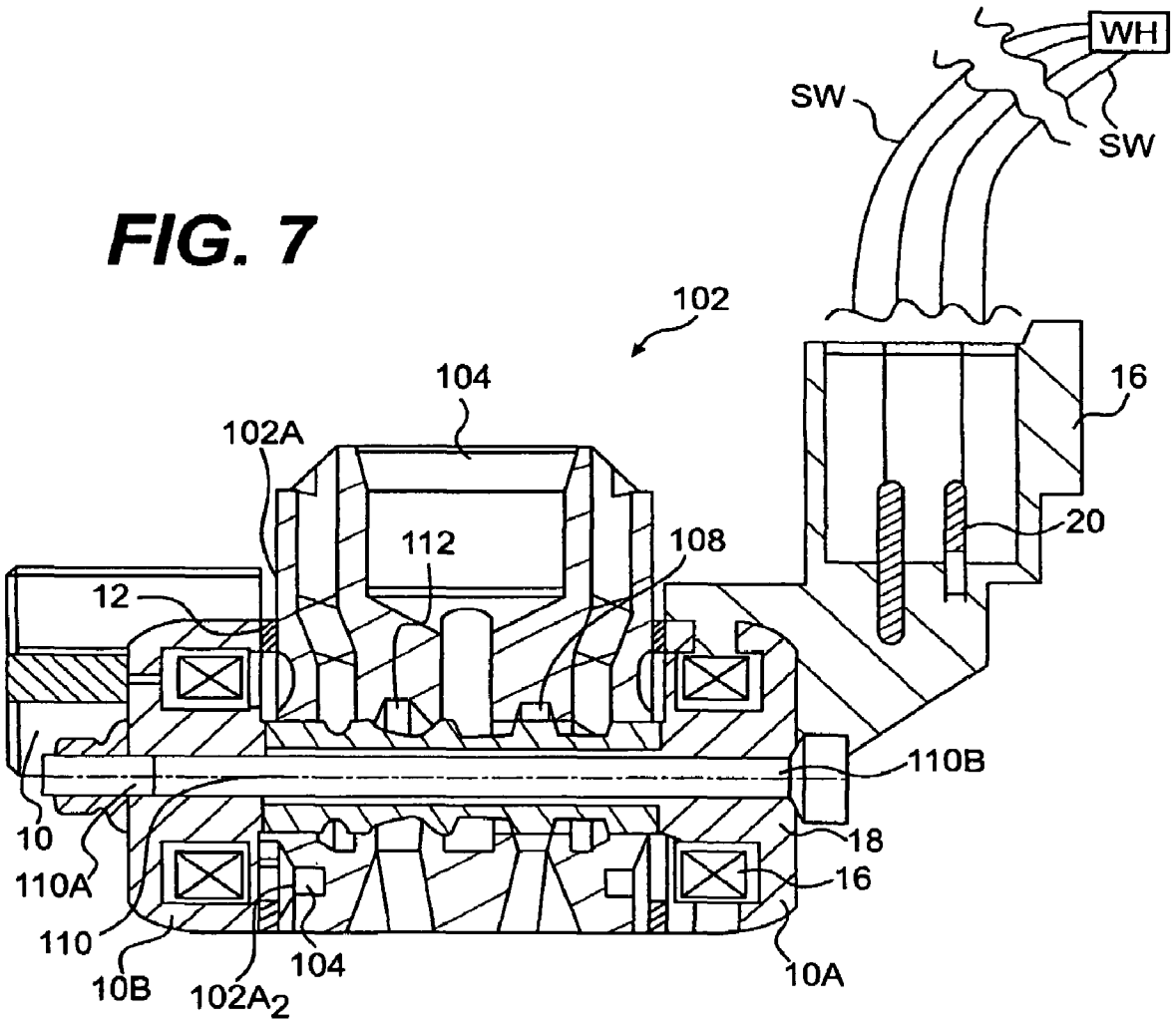
FIG. 7 is an exploded view of the control valve body and the solenoid end cap assembly of the present invention.

FIG. 5 shows a top view of the embodiment of the solenoid end cap assembly with four connector terminals 20. The connector terminals 20 are housed within the housing 16 which, in embodiments, extends away from the solenoid end cap 10. Solenoid wires 22 extend from the solenoid end cap 10. The solenoid wires 22 are designed to couple with the connector terminals 20 of a solenoid placed on an opposing side of the control valve body. For illustrative purposes only and not to be a limiting feature, the embodiment of FIG. 4 may be a closed side solenoid coil and the embodiment of FIG. 5 may be an open side solenoid coil. The solenoid wires 22, extending from the open side solenoid coil, are routed around the control valve body of the fuel injector and are coupled to the two connecting terminals 20 of the closed side solenoid coil. In this manner, electrical coupling of the solenoid coils can be easily accomplished. Additionally, in this configuration, the solenoid wires will not interfere with the rocker arm assemblies or be positioned over an ejection port of the control valve body thus eliminating fray, fatigue or types of failure of the solenoid wires. Additional solenoid wires are coupled to the terminal connectors of the embodiment of FIG. 5 and extend to a wire harness WH (FIG. 7).

Figure 6:
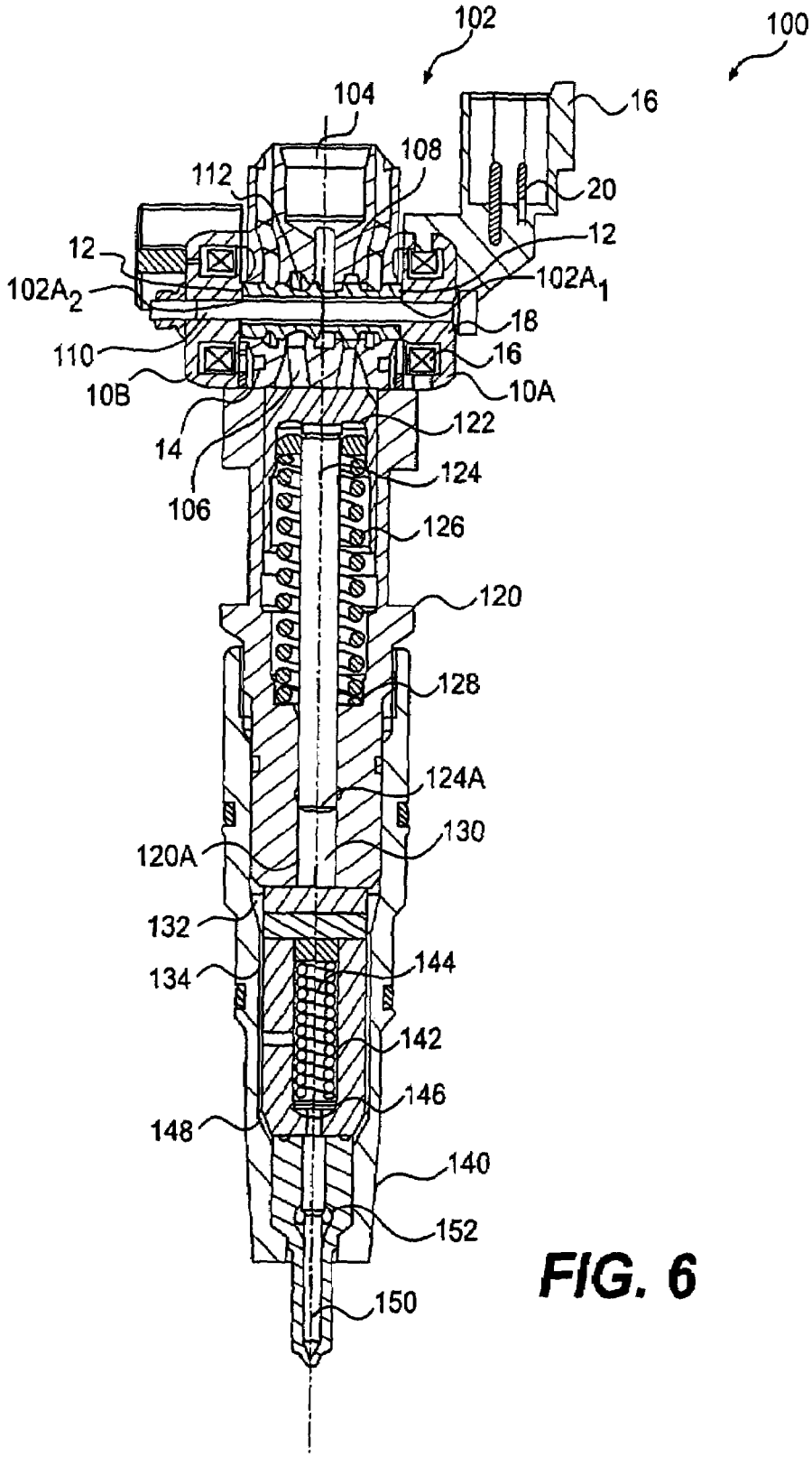
FIG. 6 shows a fuel injector with a control valve body design using the solenoid end cap assembly of the present invention.

FIG. 6 shows a fuel injector with a control valve body design for use with the solenoid end cap assembly of the present invention. The fuel injector is generally depicted as reference numeral 100 and includes a control valve body 102 as well as an intensifier body 120 and a nozzle 140. The control valve body 102 includes an inlet area 104 which is in fluid communication with working ports 106. At least one groove or orifice (hereinafter referred to as grooves) 108 is positioned between and in fluid communication with the inlet area 104 and the working ports 106. A spool 110 having at least one groove or orifice (hereinafter referred to as grooves) 112 is slidably mounted within the control valve body 102. An open coil assembly 10A and a closed coil assembly 10B, both housed within respective solenoid end cap assemblies of the present invention, are positioned on opposing sides of the spool 110. As shown in FIGS. 6 and 7, spool 110 has opposite end portions 110A, 110B disposed in a bore within each coil 18 of the coil assemblies 10A, 10B such that the end portions of the spool and the bore of the coil are separated by only a working gap. The coil assemblies 10A and 10B are energized via a driver (not shown) to drive the spool 110 between a closed position and an open position. In the open position, the grooves 112 of the spool 110 are aligned with grooves 108 of the valve control body 102 thus allowing the working fluid to flow between the inlet area 104 and the working ports 106 of the valve control body 102. The substantially flat surface 12 of the solenoid end cap 10 is designed to mate with a substantially flat surface 102$A_1$ of the valve control body 102.

Still referring to FIG. 6, the intensifier body 120 is mounted to the valve control body 102 via any conventional mounting mechanism. A piston 122 is slidably positioned within the intensifier body 120 and is in contact with an upper end of a plunger 124. An intensifier spring 126 surrounds a portion (e.g., shaft) of the plunger 124 and is further positioned between the piston 122 and a flange or shoulder 128 formed on an interior portion of the intensifier body 120. The intensifier spring 126 urges the piston 122 and the plunger 124 in a first position proximate to the valve control body 102. In general, a high pressure chamber 130 is formed by an end portion 124A of the plunger 124 and an interior wall 120A of the intensifier body 120.

The nozzle 140 includes a fuel inlet 132 in fluid communication with the high pressure chamber 130 and a fuel bore 134. It should be recognized that the fuel bore 134 may be straight or angled or at other known configuration. This fluid communication allows fuel to flow from the high pressure chamber 130 to the nozzle 140. A spring cage 142, which typically includes a centrally located bore, is bored into the nozzle 140. A spring 144 and a spring seat 146 are positioned within the centrally located bore of the spring cage 142. The nozzle 140 further includes a bore 148 in alignment with the bore 134. A needle 150 is preferably centrally located with the nozzle 140 and is urged downwards by the spring 144. A fuel chamber 152 surrounds the needle 150 and is in fluid communication with the bore 148.

FIG. 7 is an exploded view of the valve control body and solenoid end caps of the present invention. In this figure, it is recognized that the valve control body 102 includes a substantially flat surface 102$A_1$ which is designed to mate with the substantially flat surface 12 of the solenoid end cap 10. This flat mating feature eliminates the space between the solenoid end cap 10 and the valve control body 102 and thus increases the thermal conductivity therebetween. This results in the valve control body 102 acting as a heat sink for heat generated from the solenoid end cap 10. In other words, the flat surfaces of both the solenoid end cap 10 and the valve control body, which creates a large surface area connection, allows for the efficient transfer of heat from the solenoid end cap 10 to the valve control body 102. Additional solenoid wires SW extend to a wire harness WH.

The mating of the flat surfaces between the solenoid end caps 10 and the valve control body 102 also eliminate the need for a ring dowel assembly. (Instead, the pin 14 is used to align the solenoid end cap with the valve control body.) Thus, the milling of the valve control body is eliminated which concurrently eliminates the need for diametrical clearances within the valve control body. This not only increases the overall thermal conductivity of the system but also results in each coil solenoid being seated in the same position on the valve control body for each fuel injector. Now, there are no positional variances in the placement of the solenoid coils, themselves, for each fuel injector. This ensures that the transmission of magnetic flux will not vary from fuel injector to fuel injector thereby resulting in more uniform performance characteristics between different fuel injectors. That is, the spool on each fuel injector will shift at the same rate, contributing to the overall efficiency of the engine operations.

It is further of note that the use of the present invention also eliminates complicated assembly steps and manufacturing processes. By way of example, a complex milling of the valve control body 102 and the solenoid end cap is no longer needed in order to provide a seat for the ring dowel. Additionally, there is no longer any requirement for the ring dowel to be press fitted into a milled seat of the valve control body. In fact, since there is no requirement for the dowel ring, altogether, there is now fewer parts needed for the assembly of the fuel injector thereby reducing the overall cost of the fuel injector.

FIG. 7 further shows an indentation or small cut portion 102$A_2$ positioned between the solenoid end cap 10 and the valve control body 102. The indentation 102$A_2$ can be easily cast into the valve control body. In the assembled product, the indentation 102$A_2$ allows for the formation of a space between the solenoid end cap 10 and the valve control body 102. (This is compared to the complicated space used for the ring dowel and protruding coil of the conventional system.) This space ensures that there is no stray magnetic flux between the circuit formed by the valve control body, the spool and the solenoid end caps. That is, in embodiments, the space provides an air gap around the spool thus ensuring that there is no magnetic short. This space is preferably about 1.9 mm, but may be larger or smaller depending on the particular application used with the present invention.

While the invention has been described in terms of preferred embodiments, those skilled in the art will recognize that the invention can be practiced with modification within the spirit and scope of the appended claims.

What is claimed is:

1. A solenoid end cap assembly adapted to be coupled to a valve control body of a fuel injector, said solenoid end cap assembly comprising:

a body having a substantially hollow interior portion and a single planar mating surface extending between edges of the body;

a solenoid coil housed within the substantially hollow interior portion; and a slidable spool having a portion disposed within said solenoid coil such that said spool portion and said solenoid coil are separated by only a working gap, wherein said slidable spool has at least one groove that aligns with a working port in an open position to allow fuel to flow therethough.

2. The solenoid end cap assembly of claim 1, further comprising solenoid wires extending from the body.

3. The solenoid end cap assembly of claim 1, further comprising a receptacle extending outwardly from the body, the receptacle housing having connector terminals.

4. The solenoid end cap assembly of claim 3, wherein said connector terminals connect to a wire harness by a set of solenoid wires.

5. The solenoid end cap assembly of claim 4, wherein said connector terminals are four connector terminals.

6. The solenoid end cap assembly of claim 3, wherein said connector terminals are two connector terminals.

7. The solenoid end cap assembly of claim 3, wherein the receptacle extending outwardly from the body routes solenoid wires away from the valve control body thus eliminating fraying or fatigue of the solenoid wires.

8. The solenoid end cap assembly of claim 1, further comprising at least one protruding alignment pin which mates with the valve control body.

9. The solenoid end cap assembly of claim 8, wherein said at least one protruding alignment pin extends outwardly from the body.

10. The solenoid end cap of claim 1, wherein said single planar mating surface is substantially flat.

11. The solenoid end cap of claim 10, wherein said solenoid coil forms part of the single planar surface.

12. The solenoid end cap assembly adapted to be coupled to a valve control body of a fuel injector, said solenoid end cap assembly comprising:

a body having a substantially hollow interior portion and a single substantially flat mating surface;

a solenoid coil housed within the substantially hollow interior portion; and a slidable spool having a portion disposed within said solenoid coil such that said spool portion and said solenoid coil are separated by only a working gap, wherein the slidable spool has at least one groove that aligns with a working port in an open position to allow fuel to flow therethough, and wherein a mating face of the solenoid coil forms part of the substantially flat mating surface.

13. The solenoid end cap assembly of claim 12, wherein said solenoid coil does not extend past the substantially flat surface.

14. A solenoid end cap assembly adapted to be coupled to a valve control body of a fuel injector, said solenoid end cap assembly comprising:

a body having a substantially hollow interior portion and a substantially flat mating surface;

a solenoid coil housed within the substantially hollow interior portion;

a slidable spool having a portion disposed within said solenoid coil assembly such that said spool portion and said solenoid coil are separated by only a working gap, wherein the slidable spool has at least one groove that aligns with a working port in an open position to allow fuel to flow therethough;

a receptacle extending away from the body, said receptacle having connector terminals which connect to solenoid wires; and at least one protruding alignment pin extending outward from the substantially flat mating surface of the body, remote from the solenoid coil.

15. The solenoid end cap assembly of claim 14, wherein said receptacle extending outwardly from the body routes solenoid wires away from the valve control body thus eliminating fraying or fatigue of the solenoid wires.

16. The solenoid end cap assembly of claim 14, wherein said connector terminals are four connector terminals which connect to a wire harness by a set of additional solenoid wires.

17. The solenoid end cap assembly of claim 14, wherein said at least one protruding alignment pin is molded into the body.

18. The solenoid end cap assembly of claim 17, wherein a mating face of the solenoid coil forms part of said substantially flat mating surface.

19. The solenoid end cap of claim 14, wherein said substantially flat mating surface is a single planar surface.

20. The solenoid end cap of claim 19, wherein a mating face of the solenoid coil forms part of said single planar surface.

21. A valve control body assembly for use with a fuel injector, comprising:

a valve control, comprising:

a body having at least one substantially flat mating surface at opposing sides thereof;

at least one indentation formed on the opposing sides of the body, an oil inlet area, at least one oil outlet port, and a fluid pathway providing fluid communication between the oil inlet area and the at least one oil outlet port; and at least one solenoid end cap having a substantially flat mating surface extending between edges of said at least one solenoid end cap for mating with said at least one substantially flat mating surface of the body of the valve control, said at least one solenoid end cap comprising:

a solenoid coil; and a slidable spool having a portion disposed within said solenoid coil such that said spool portion and said solenoid coil are separated by only a working gap, wherein said slidable spool has at least one groove that aligns with a working port in an open position to allow fuel to flow therethough, and wherein said at least one indentation and said substantially flat mating surface of said at least one solenoid end cap form a space between said body and said at least one solenoid end cap.

22. The valve control body assembly of claim 21, wherein said at least one solenoid end cap includes at least one protruding alignment pin extending therefrom.

23. The valve control body assembly of claim 21, wherein said at least one solenoid end cap includes an outwardly extending receptacle having connector terminals.

24. The valve control body of claim 21, wherein said substantially flat mating surfaces of the body and said at least one solenoid end cap form a single planar mating surface.

25. A valve control body assembly for use with a fuel injector, comprising:

a valve control, comprising:

a body having at least one substantially flat mating surface at opposing sides thereof, at least one indentation formed on the opposing sides of the body, an oil inlet area, at least one oil outlet port, and a fluid pathway providing fluid communication between the oil inlet area and the at least one oil outlet port; and at least one solenoid end cap having a substantially flat mating surface for mating with said at least one substantially flat mating surface of the body of the valve control, wherein;

said at least one indentation and said substantially flat mating surface of said at least one solenoid end cap form a space between the body and said at least one solenoid end cap;

said at least one solenoid end cap includes at least one protruding alignment pin extending therefrom;

said at least one solenoid end cap comprises a first solenoid end cap and a second solenoid end cap;

said first solenoid end cap having a first outwardly extending receptacle including four connector terminals extending therefrom; and said second solenoid end cap having a second outwardly extending receptacle including two connector terminals extending therefrom.

26. The valve control body assembly of claim 25, wherein at least one solenoid wire extends from said first solenoid end cap and connects to said connector terminals extending from the outwardly extending receptacle of said second solenoid end cap.

27. The valve control body assembly of claim 26, wherein at least another solenoid wire is coupled between the connector terminals extending from the outwardly extending receptacle of said first solenoid end cap and a wire harness assembly.

28. The valve control body assembly of claim 25, wherein said first and second outwardly extending receptacles route solenoid wires around the body of the valve control.

29. A fuel injector comprising:

a valve control body assembly, comprising:

a body having at least one substantially flat surface at opposing sides thereof, an oil inlet area, at least one oil outlet port, and a fluid pathway providing a fluid pathway between the oil inlet area and the at least one oil outlet port;

at least one solenoid end cap having a substantially flat surface and mating with said at least one substantially flat surface of the body of the valve control;

an intensifier body in fluid communication with the at least one oil outlet port;

a nozzle assembly in fluid communication with the intensifier body; and an indentation formed in said body on the opposing sides, said indentation forms a gap between said at least one solenoid end cap and said body of the valve control body assembly, wherein:

said at least one solenoid end cap comprises a first solenoid end cap and a second solenoid end cap;

a first and second outwardly extending receptacle formed on each of said first and second solenoid end caps, respectively, said first and second outwardly extending receptacles each having connector terminals extending therefrom;

at least one solenoid wire extending from said first solenoid end cap and connects to the connector terminals of said second outwardly extending receptacle; and at least another solenoid wire is coupled between the connector terminals of said first outwardly extending receptacle and a wire harness assembly.

30. The fuel injector of claim 29, wherein the first and second outwardly extending receptacles maintain said solenoid wires away from said body of the valve control body assembly.

31. The fuel injector of claim 29, wherein said first outwardly extending receptacle includes four connector terminals and said second outwardly extending receptacle includes two connector terminals.

32. The fuel injector of claim 29, wherein said substantially flat surfaces of the body and said at least one solenoid end cap are each a single planar mating surface.

* * * * *